US006957555B1

(12) United States Patent
Nagel et al.

(10) Patent No.: US 6,957,555 B1
(45) Date of Patent: Oct. 25, 2005

(54) LOCKING ATTACHMENT FOR PRODUCT DISPLAY HOOKS

(75) Inventors: Thomas O. Nagel, Blairstown, NJ (US); Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 10/862,305

(22) Filed: Jun. 7, 2004

(51) Int. Cl.[7] ..... E05B 65/00

(52) U.S. Cl. ..... 70/57.1; 248/220.31; 211/7; 211/57.1

(58) Field of Search ..... 70/57.1, 58, 62; 211/7, 8, 54.1, 57.1, 59.1; 248/220.21, 220.31, 248/220.41, 220.22, 222.51

(56) References Cited

U.S. PATENT DOCUMENTS 892,407 A * 7/1908 Courtney ..... 211/9
3,918,278 A * 11/1975 Spear ..... 70/58
4,063,646 A * 12/1977 Stahl, Jr. ..... 211/4
4,289,242 A * 9/1981 Kenyon ..... 211/4
4,351,440 A * 9/1982 Thalenfeld ..... 211/57.1
4,889,304 A * 12/1989 Glickman et al. ..... 248/222.13
5,027,622 A * 7/1991 Hatch et al. ..... 70/14
5,259,220 A * 11/1993 Fredrickson ..... 70/14
5,275,027 A * 1/1994 Eklof et al. ..... 70/14
5,348,167 A * 9/1994 Jensen ..... 211/57.1
5,676,258 A * 10/1997 Leyden et al. ..... 211/7
5,689,978 A * 11/1997 Eklof et al. ..... 70/62
6,003,685 A * 12/1999 Malin ..... 211/7
6,364,124 B1 * 4/2002 Chen ..... 211/4
6,474,478 B1 * 11/2002 Huehner et al. ..... 211/4
6,601,808 B1 * 8/2003 Nagel ..... 248/220.31
6,622,979 B2 * 9/2003 Valiulis ..... 248/220.42
6,659,291 B2 * 12/2003 Huehner et al. ..... 211/4
2004/0026344 A1 * 2/2004 Sedon et al. ..... 211/7
2004/0084386 A1 * 5/2004 Huehner et al. ..... 211/4
2005/0029205 A1 * 2/2005 Mansfield et al. ..... 211/7

* cited by examiner

*Primary Examiner*—Suzanne Dino Barrett
(74) *Attorney, Agent, or Firm*—Schweitzer Cornman Gross & Bondell LLP

(57) ABSTRACT

A merchandise locking device for retrofit attachment to a product display hook installed on a merchandise display panel. The locking device attaches without tools to the upper wire arm of the display hook for pivoting movement between "lock" and "open" positions. A laterally opening recess in the locking device receives the lower arm of the display hook and a locking arm, rotatably mounted in the body of the locking device by a rotor element, closes the recess to lock the device to the lower arm and prevent the removal of merchandise therefrom. A simple key carried by store personnel enables the rotor to be released to free the locking device from the lower arm and permit the removal of merchandise. The locking device consists of four elements, including the key, and can be manufactured at very low cost, suitable for mass merchandise applications. Simple changes in rotor components enable the locking device to be operated by different keys, which may be color coded with the locking devices or components thereof. A bracket is also provided for retrofit attachment to the display hook, to prevent bodily removal of the hook and its contents from the display panel.

17 Claims, 4 Drawing Sheets

LOCKING ATTACHMENT FOR PRODUCT DISPLAY HOOKS

BACKGROUND OF THE INVENTION

Product display hooks are extensively used in connection with the merchandising of products of all types, particularly by mass merchandise chain stores and the like. Typically, product display units, sometimes referred to as gondolas, are formed with a back panel of apertured panel board. The apertured panel board serves as a mounting for a large number of display hooks on which the merchandise is mounted. An advantageous form of display hook is formed of wire and is provided with upper and lower outwardly extending arms. The upper arm mounts a label holder for pricing and other product information, while the lower arm receives the merchandise, typically mounted on cards with openings to receive the projecting wire of the display hook.

In some cases, the articles of merchandise supported on the display hooks can be of a relatively expensive nature (for example, dry cell batteries). Historically, the more expensive merchandise items increasingly become the subject of shoplifting, resulting in considerable loss to the merchandiser.

Various schemes have been proposed to minimize "shrinkage" resulting from theft. Among these are specially designed product display hooks incorporating built-in locking arrangements requiring the presence of a store clerk to release a product item from the display hook. While such arrangements effectively minimize shrinkage losses, they have suffered from serious disadvantages. Typically, such specially designed hooks have been very costly compared to standard display hooks. Additionally, installation of the special locking hooks frequently is difficult because of the density of hooks in a typical display panel. Moreover, after the installation has been completed, the overall product display may look somewhat haphazard because of the variety of hooks involved, with the special locking hooks being interspersed randomly among conventional hooks, in accordance with the location of the expensive product items, in many cases resulting in a relatively unattractive display.

SUMMARY OF THE INVENTION

Pursuant to the invention, a novel and improved locking device is provided which is adapted for installation on conventional product display hooks, such that locking devices may be selectively applied in an existing product display, by attaching locks to those hooks containing products likely to be the subject of theft. Significantly, the locking device of the invention can be provided at exceptionally low cost, suitable for large scale utilization by mass merchandisers.

Pursuant to the invention, the locking device can be quickly and easily attached to the upper wire arm of a product display hook, with a snap-in action, without requiring special tools or the like. Once attached to the upper wire arm, the locking device can be pivoted into a locking position in front of the merchandise, to prevent its unauthorized removal, from the lower arm of the display hook. The locking device can be secured in the locked position, releasable only by the use of an appropriate key carried by store personnel. Once released, the locking device can be pivoted upward to an out of the way position to enable removal of the displayed product.

In a preferred embodiment of the invention, a lock body, formed of an engineering plastic material, is provided with recesses for the reception of the upper and lower wires of a display hook. A snap-on closure is provided for securing the upper recess to the upper wire for pivotal mounting of the lock body. The lower recess preferably is in the form of an open-sided slot which is received around the lower wire of the display hook. A lock rotor is mounted within a circular opening in the lock body and is adapted for limited rotation with respect to the lock body. The lock rotor carries a locking arm which, when the rotor is rotated to a lock position, closes the open side of the lower recess to lockingly secure the lock body to the lower wire. Cooperating elements on the lock body and rotor secure the rotor in its lock position. The rotor is formed with an axially directed slot for the reception of a key, which will permit rotation of the rotor to an open position, to release the lock body for pivotal movement, thereby allowing merchandise to be removed from the hook.

A simplified and advantageous lock and key system enables a variety of lock and key combinations to be employed such that different keys can be required to open different locking devices, advantageously utilizing a color scheme, for example, to associate particular locking devices with the keys required to open them.

An additional aspect of the invention resides in the provision of a simple bracket and pushpin arrangement, suitable for easy retrofit installation, for securing a display hook to its display panel. Thus, in those instances in which indicating the desirable utilization of the locking device of the invention to prevent removal of merchandise from the display hook, it typically may be desired to secure the display hook itself to the display panel to prevent the hook from being bodily removed from the panel, together with its locked-on merchandise.

For a more complete understanding of the above and other features and advantages of the invention, reference should be made to the following detailed description of a preferred embodiment and to the accompanying drawings.

DESCRIPTION OF A PREFERRED EMBODIMENT

Figure 1:
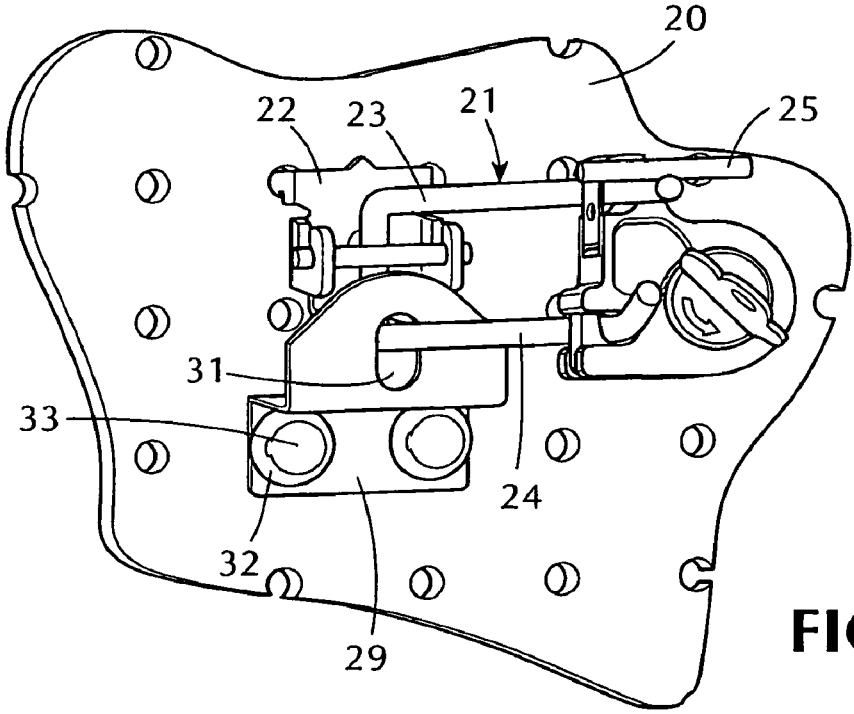
FIG. 1 is a perspective view showing a product display hook of known type having mounted at an outer end thereof a locking device according to the invention, FIG. 1 showing the locking device in its "lock" position.
Figure 2:
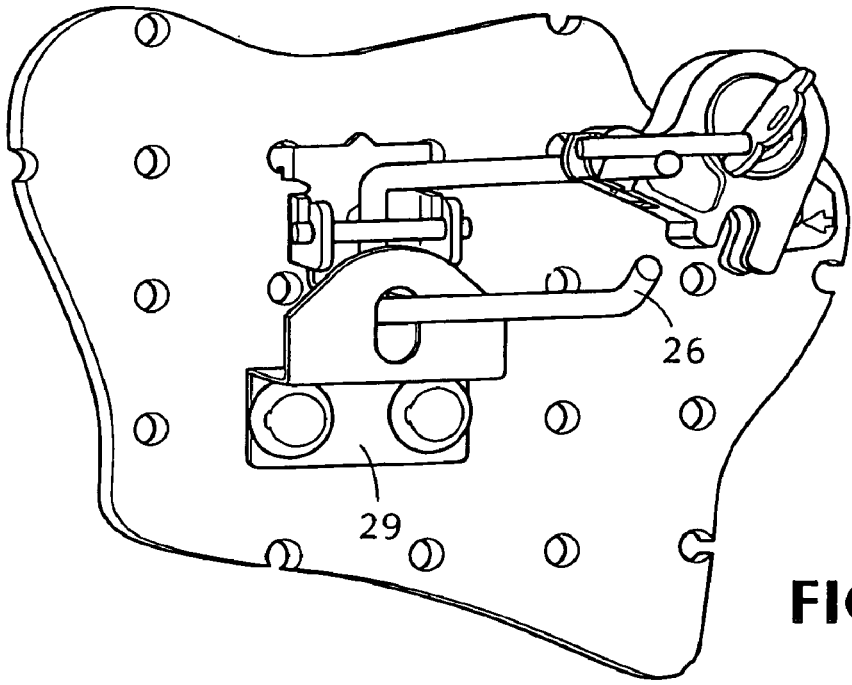
FIG. 2 is a view similar to FIG. 1, but showing the locking device of the invention pivoted to an "open" position.
Figure 3:
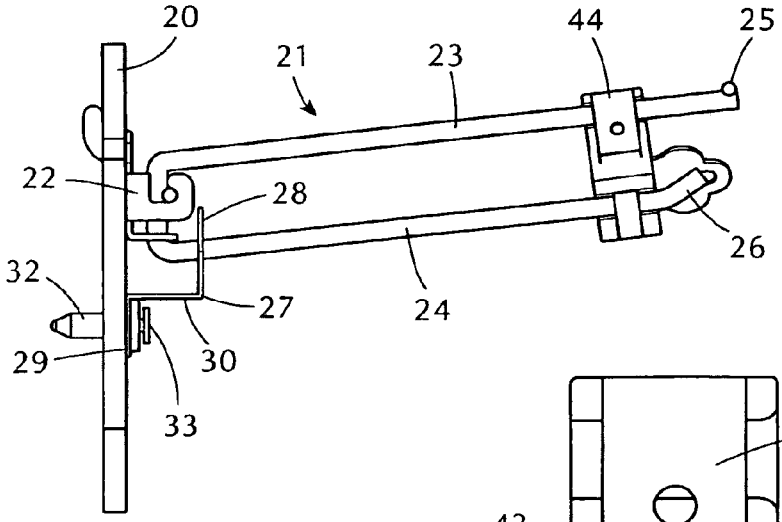
FIG. 3 is a side elevational view of the hook and lock arrangement of FIG. 1.
Figure 4:
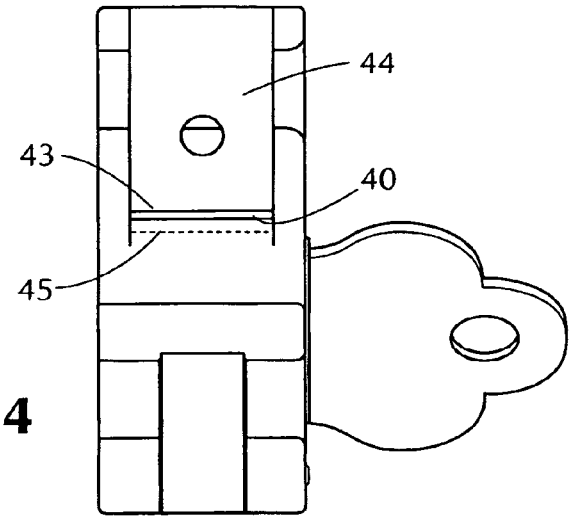
FIG. 4 is a side elevational view of the locking device of the invention, shown with a key inserted therein.

Referring now to the drawings, and initially to FIGS. 1–3 thereof, the reference numeral 20 designates a typical apertured panel board forming part of a merchandising display. A display hook, which can be of known type, is mounted on the panel board 20. The display hook 21 includes a base member 22 display hook which engages openings in the panel board and mounts upper and lower, outwardly extending wire arms 23, 24. The wire arms 23, 24 advantageously (but not necessarily) are joined as one piece, and the two arms extend outwardly in a generally parallel relationship, as illustrated in FIGS. 1–3.

The upper arm 23 of the display hook typically is provided with a label holding facility for displaying product pricing and information. In the illustrated arrangement, this is in the form of a welded-on crossbar 25, located at the outer end extremity of the upper wire arm 23. The crossbar 25 is adapted to receive a pivoted label holding element (not shown) with the appropriate product information. The lower arm 24 is intended for the support of displayed product (not shown) typically in the form of one or more product items mounted on a blister card or the like which is suspended from the lower arm 24. Typically, the outer end portion 26 of the wire arm 24 is bent upwardly slightly to minimize accidental disengagement of a carded product item.

In circumstances warranting the use of the locking device of the invention, it is, of course, equally important to prevent the entire hook from being bodily removed from the panel board 20 which could result in the loss of the hook, the lock and all of the merchandise. To this end, the invention, in one of its aspects, contemplates the provision of an advantageous form of retrofit bracket, which can be applied to a conventional, previously installed display hook to inhibit its removal. As shown in FIGS. 1–3, a bracket 27, typically a metal stamping, is formed with front and back panels 28, 29 offset by a horizontal panel 30. The front panel has an opening 31 for reception over the lower wire arm 24 of the display hook, and the back panel 29 has a pair of spaced apart openings aligned with an adjacent pair of openings in the panel board 20. Pushpins 32 extend through the back panel 29 and through the underlying apertures in the panel 20. The pushpins include telescoping, plunger elements 33 which, when pressed fully inward, expand the pushpins behind the panel board and lock the pins in position requiring a tool for removal. The bracket 27 and pushpins 32 thus provide a quick and easy retrofit arrangement for effectively securing the display hook 21 together with the apertured display panel 20.

Referring now to FIGS. 4–12, the locking device of the invention includes a lock body 35 (FIGS. 7–9), which can be injection molded of a suitable engineering plastic material. The lock body 35 includes upper and lower slot-like recesses 36, 37 for the reception of the upper and lower arms 23, 24, respectively, of a display hook. The lock body has a generally circular opening 38 therein, which preferably extends from the front to the back of the lock body and is adapted to receive a lock rotor 39 (FIGS. 10–12) as will be described in greater detail.

At the front of the lock body 35, slightly below the upper recess 36, there is a slot 40 that extends through a front wall portion 41 of the lock body and into a recess 42 therein. The slot 40 receives a lower tongue portion 43 (FIG. 4) of a mounting clip 44, which is preferably formed of light sheet metal material. The tongue portion 43 has a first portion extending inwardly through the slot 40, and a second portion 45 which extends downwardly within the recess 42. The clip 44 is assembled with the lock body by inserting the tongue 43 through the slot 40 and pivoting the clip 44 upwardly. The upper portion 46 of the clip 44 is curved over the upper portion of the lock body, and a downwardly extending tab 47, at the upper end of the clip, is adapted to snap over a shoulder 48 formed at the top of the plastic lock body 35. The clip 44 enables the lock body to be secured to the display hook by applying the open sided recess 36 over the upper arm 23 and then pressing the clip 44 in a closing direction until the flange 47 snaps over the shoulder 48. The lock body is then securely attached to the wire arm 23. No tools are required, however, removal requires the use of a tool to pry open the clip 44.

As shown in FIG. 3, when the clip body is attached to the upper arm 23, it is effectively locked onto the display hook, because the cross bar 25 prevents the lock body from being withdrawn off of the front of the wire 23. However, the lock body is free to pivot about the axis of the wire 23 as reflected in FIGS. 1 and 2.

Figure 7:
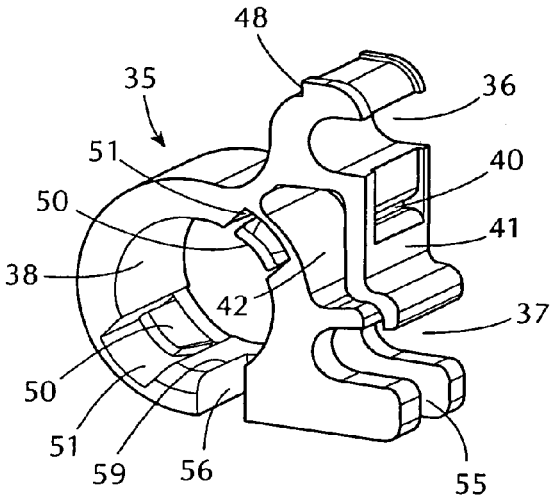
FIG. 7 is a perspective view, from the back side, of a molded lock body element incorporated in the locking device of the invention.
Figure 8:
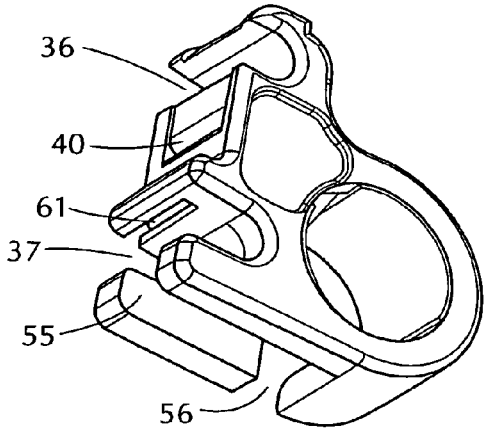
FIG. 8 is a perspective view, from the front side, of the lock body of FIG. 7.
Figure 9:
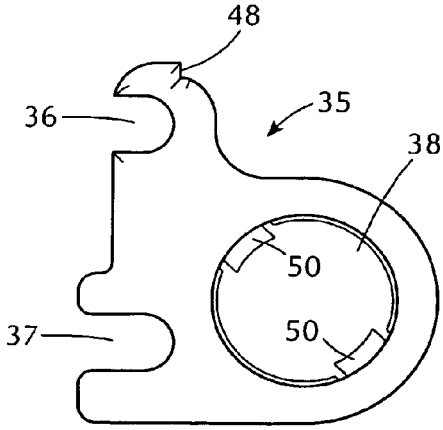
FIG. 9 is a front elevational view of the lock body of FIG. 7.

Referring now to FIGS. 7–9, the lock body molding includes a pair of opposed, resiliently biased stop elements 50, which are anchored within recesses 51 in the lock body, toward the back side of the body, and project forwardly and radially inwardly. The arrangement is such that the free ends of the stop elements 50 project into the circular opening 38 as reflected in FIG. 9 of the drawing.

Figure 10:
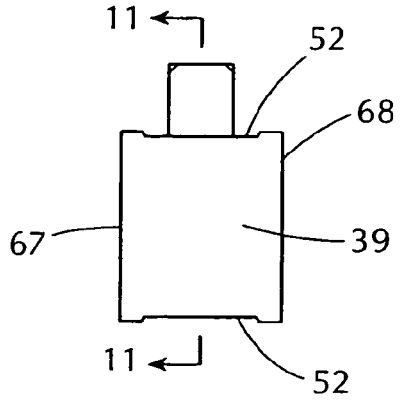
FIG. 10 is a side elevational view of a lock rotor element incorporated in the locking device of the invention.
Figure 11:
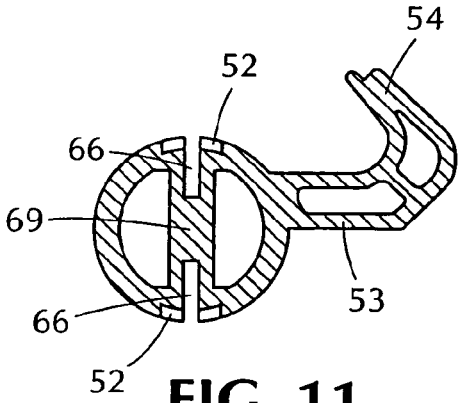
FIG. 11 is a cross sectional view as taken generally on line 11—11 of FIG. 10.
Figure 12:
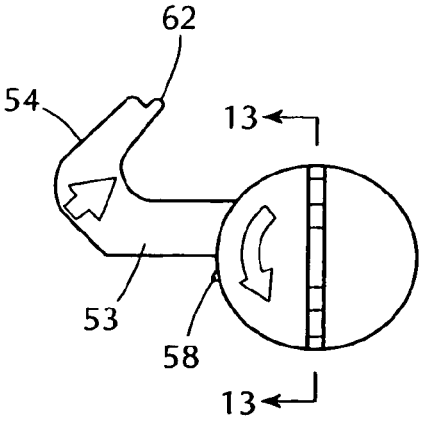
FIG. 12 is a front elevational view of the rotor element of FIG. 10.

The rotor element 39, shown in FIGS. 10–12, has a body of generally circular configuration, of a size to be received closely within the circular opening 38 of the lock body. The rotor includes a pair of diametrically opposed locking recesses 52 (FIG. 11) which extend for most of the axial length of the motor element, stopping short of each end thereof, however, as indicated in FIG. 10. When the rotor 39 is positioned within the circular opening 38, the recesses 52 are positioned to receive the resilient stop elements 50, which then function to prevent rotation of the rotor relative to the lock body.

Pursuant to the invention, the rotor 39 has an integral locking arm 53 extending outward from a side wall portion thereof and formed with a hook portion 54 at its outer end. The lock body 35, as shown in FIGS. 7 and 8, includes a laterally opening slot 55 in its lower portion for receiving the locking arm 53. In addition, there is a rearwardly opening slot 56 extending generally vertically downward from the circular opening 38 and connecting with the laterally opening slot 55.

When the rotor 39 is initially assembled with the lock body, the rotor is first oriented such that the locking arm 53 extends vertically downward. The rotor is then inserted into the back of the opening 38, while the resilient stop elements 50 are temporarily displaced radially outwardly to pass over the outer cylindrical contours of the rotor. During this assembly process, the locking arm 53 is received within the vertical slot 56, which allows the rotor to be seated properly within the circular opening.

Once the rotor is properly seated, it is rotated, for example by pressing on the locking arm, to rotate the locking arm away from the vertical slot 56 and into the laterally opening slot 55. After a few degrees of such rotational movement, a small, anti-rotation element 58 (FIG. 12) passes by a back edge 59 of the downwardly opening slot 56 (see FIG. 7). This limits reverse rotation of the rotor element such that, during normal operations of the locking device, the rotor element cannot be positioned with its locking arm 53 aligned with the vertical slot 56 under any circumstances.

Figure 6:
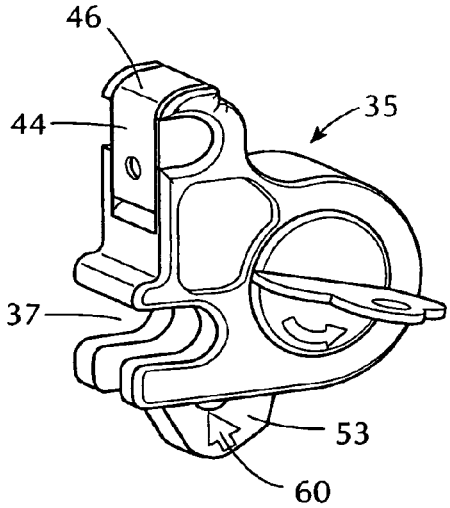
FIG. 6 is a perspective view of the locking device of FIG. 5, with the device in an open or unlocked position.

After an initial assembly of the rotor element 39 to the lock body 35, the locking device will be in an "open" condition as shown in FIG. 6. Assuming the locking device to be already mounted on a display hook, as shown, for example, in FIGS. 1 and 2, the locking device can be pivoted into a position in which the lower wire arm 24 is received within the laterally opening recess 37 of the lock body. The locking arm 53 may then be closed, for example, by manually pressing upwardly, as suggested by the indicator arrow 60 in FIG. 6. This causes the rotor element to rotate within the lock body and the hook portion 54 of the locking arm to be moved into a position closing off the outer end of the recess 37. This captures the lower display arm 24 and, thus, prevents removal of any merchandise supported on the arm 24.

Figure 5:
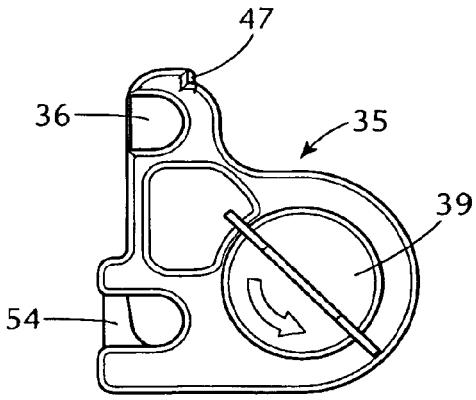
FIG. 5 is a front elevational view of the locking device of FIG. 4, illustrating the device in its "lock" position.

When the locking arm 53 is rotated to the locking position, shown in FIG. 5, the recesses 52 of the rotor element 39 line up with the resiliently biased stop elements 50 of the lock body. The stop elements thus snap into the recesses and prevent any rotation of the rotor to release the locking device from its locked position.

Advantageously, the lock body 35 is formed with a recess 61 in an upper portion of the recess 37 (see FIG. 8 of the drawing). Likewise, the hook portion 54 of the locking arm is formed with a projection 62 at its end, which is positioned to be received within the recess 61 of the lock body when the rotor element 39 and locking arm are in their locked position. This minimizes the likelihood of a vandal breaking off the outer end of the locking arm.

In order to release the locking device from its locked condition, it is necessary to displace the elastically biased stop elements 50 radially outward to a point beyond the cylindrical contours of the rotor element. In the device of the present invention, this is done by inserting a simple key element, such as reflected at 65 in FIG. 14, into an axial slot 66 formed in the rotor element 39. The slot 66 preferably extends from the front face 67 of the rotor element toward but preferably not entirely to the back face 68. As shown in FIG. 11, the key slot 66 preferably has upper and lower portions separated by a central pedestal portion 69 that serves to join opposite sides of the rotor.

The key 65 typically can be a simple metal stamping of flat form, opposite edges 70 of which are spaced apart a distance equal to or just slightly greater than the diameter of the rotor element 39 such that, when the key 65 is inserted in the slot 66, the opposite edges of the key will serve to displace the resilient stop elements 50 sufficiently to enable the rotor element to be turned in an opening direction. The rotor element can be rotated in a locking direction either by manipulation of the key 65 or by manually pressing on the locking arm 53 as heretofore described. However, the presence of the key is required to displace the stop elements 50, in order to enable the rotor to be moved to an "open" position.

Figure 13:
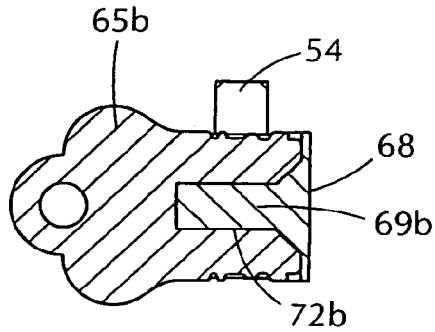
FIGS. 13–15 are cross sectional views, as taken generally along line 13—13 of FIG. 12, illustrating a variety of lock and key arrangements that can be utilized in connection with the locking device of the invention, such that a merchandiser may use three or four different lock and key combinations for optimum protection of its merchandise.
Figure 14:
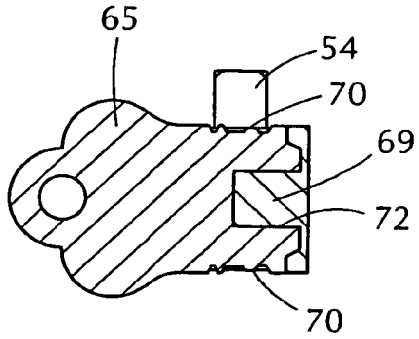
Figure 15:
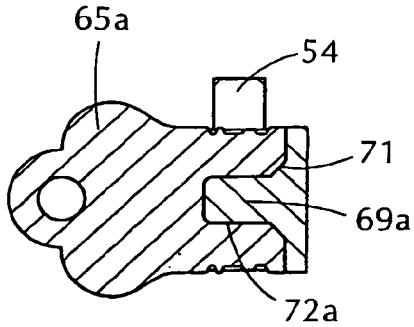

In a particularly preferred embodiment of the invention, the rotor element 39 can be molded to provide pedestals of different configuration, for cooperation with various specific key configurations, such that several different keys can be provided to selectively operate different locks. In the examples shown in FIGS. 13–15, the pedestal 69 of FIG. 14 is illustrated to be relatively short in the axial direction and relatively wide in the radial direction. The pedestal 69*a* of FIG. 15 is somewhat longer axially and somewhat narrower radially, as well as being chamfered at the base as indicated at 71. The key 65*a* associated with the pedestal 69*a* has a recess 72*a* shapes to conform closely to the shape of the pedestal 69*a*. The key 65 of FIG. 14 likewise has a recess 72 closely conforming to the shape of the pedestal 69. In the key and rotor combination of FIG. 13, the pedestal 69*b* is longer than either of the pedestal shown in FIGS. 14–15, as well as narrower than both. The recess 72*b* of the key 65*b* is likewise shaped to closely conform to the shape of the pedestal 69*b*. The arrangement is such, as will be apparent from comparing FIGS. 13, 14, 15, that none of the keys 65, 65*a* or 65*b* can be properly received in any of the key slots shaped for the other keys. The recess 72 of the key 65, while being wide enough to be received over either of the pedestals 69*a*, 69*b* is too short to be fully received in the key slot and, thus, would not function. The key recesses 72*a* and 72*b* likewise are too narrow to receive the pedestal 69. Thus, by a simple shaping of pedestals and recesses, several working combinations of keys and rotors may be provided, to suit the needs and desires of the merchandisers.

It is contemplated that the keys and rotors may be color coded, so that the store personnel can easily identify which key would be operable with a given lock.

The locking device of the invention is uniquely advantageous in several respects. Importantly, it is designed for retrofit attachment to existing product display hooks. This not only eliminates the need for costly special hooks, but also greatly simplifies the installation process, because it is not necessary to remove an existing hook and install a new hook in an existing display panel. This can sometimes be time-consuming when (as is often the case) the display panel is densely populated with display hooks and merchandise. With the device of the present invention, all that is required is to snap the locking device over the upper arm of a previously installed hook, pivot the locking device into its locked position and close the locking arm. No tools are required and only a few seconds of time. The device of the invention also results in a product display of improved overall appearance, as compared to displays in which special locking hooks are installed. Since the locking hooks typically have a significantly different appearance than the regular display hooks, and typically are installed in random locations depending upon the merchandise to be protected, the resulting display tends to have a haphazard appearance.

In the device of the invention, the primary components are the lock body and the rotor element, and these can be injection molded on a high production basis at very low cost. The two additional components are a small metal clip by which the lock body is attached to the upper display arm and the key, which is a simple, flat metal stamping. All together, the device can be manufactured and sold to the mass merchandiser at an extremely low cost, entirely consistent with mass merchandising objectives. Moreover, since retrofit installation of the locking device on a display hook is so quick and easy, the labor cost factor in setting up a locked hook is insignificant.

For those circumstances in which bodily removal of the entire hook from the display panel is of concern, the locking device of the invention may be used to advantage in combination with a retrofit bracket that engages the lower arm of the display hook and is secured to the display panel through the use of plunger-actuated pushpins, which can be applied without tools but require a tool in order to effect removal.

It should be understood, of course, that the specific forms of the invention herein illustrated and described are intended to be representative only, and not to be considered limiting. Accordingly, reference should be made to the following appended claims in determining the full scope of the invention.

What is claimed is:

1. A product locking device for use in connection with a product display hook, where the product display hook comprises upper and lower wire arms having outer end portions arranged in vertically spaced relation and wherein at least one of said outer end portions has an obstructive element associated therewith, and wherein said lower arm is adapted to support merchandise items for display, which comprises (a) a lock body having means at an upper portion thereof for attaching said lock body to said upper arm at a position inward of said obstructive element for pivotal movement about an axis of said upper arm, (b) said lock body having a locking slot therein having an open side and being sized and positioned to receive said lower arm, (c) said lock body having a generally circular recess therein adjacent said locking slot, (d) a rotor element received in said circular recess and rotatable therein through a predetermined angle of rotation, (e) a locking arm fixed to and extending outward from said rotor element, and rotatable therewith between "lock" and "open" positions of said rotor element, (f) said locking arm having an end portion arranged, when said rotor element is in said "lock" position, to close the open side of said locking slot for securing said lower arm within said slot, (g) said rotor element having a locking recess in an outer portion thereof, (h) said lock body having a resiliently biased stop element thereon tending normally to project into said generally circular recess, (i) said resiliently biased stop element being received in said locking recess in said rotor element, when said recess and said stop element are rotationally aligned in the "lock" position of said rotor element, to normally prevent rotation of said rotor element out of said "lock" position, (j) said rotor element having an axially extending slot therein for reception of a key, and (k) a key insertable in said axially extending slot and having an outer surface portion engageable with said resiliently biased stop element to displace said element outwardly of said recess to enable rotation of said rotor element to said "open" position in which said locking slot is open at the side thereof to permit pivotal movement of said lock body away from said lower arm to enable removal of a displayed product therefrom.

2. A product locking device according to claim 1, wherein (a) said locking arm has a first portion extending laterally outward from said rotor element and having a hook portion extending at an angle from an outer end of said first portion for closing the open side of said locking slot when said rotor element is in a "lock" position.

3. A product locking device according to claim 2, wherein (a) a portion of said lock body forming one side of said locking slot has a recess therein opening toward said locking slot, and (b) said hook portion is formed with a projecting tab at an end extremity thereof which is received in said last mentioned recess when said rotor element is in a "lock" position.

4. A product locking device according to claim 1, wherein (a) said axially extending slot comprises diametrically opposed key slot portions in said rotor element, at least partially separated by a central, axially extending pedestal portion, (b) said key having first and second ends, with said first end being insertable into said axially extending key slot portions and said second end projecting out of said rotor element for manual engagement, (c) said first end having an axially extending recess therein for closely receiving said pedestal portion.

5. A product locking device according to claim 4, wherein (a) said lock body has a diametrically opposed pair of resiliently biased stop elements, and said rotor element has a pair of diametrically opposed locking recesses therein for reception of said stop elements, (b) said key slot portions intersection radially with said locking recesses, (c) the outer contours of said key serving to displace said stop elements outwardly out of said locking recesses to accommodate rotation of said rotor element out of a "lock" position.

6. A product locking device according to claim 1, wherein (a) said means at the upper portion of said lock body for attaching said lock body to said upper arm comprising a slot in said lock body having an open end for the reception of said upper arm, and (b) a clip adapted for snap-on attachment to said lock body to close the open end of said slot and secure said lock body to said upper arm for pivoting movement about an axis of said upper arm.

7. A product locking device according to claim 1, wherein (a) said lock body is formed with a laterally opening slot for the reception of said locking arm during rotary movements of said rotor element, (b) said lock body further includes an assembly slot, opening in an axial direction, for reception of said locking arm during axial assembly of said rotor element into said circular recess.

8. A product locking device according to claim 7, wherein (a) said lock body and said rotor element include cooperating anti-rotation elements to prevent rotation of said rotor element to align said locking arm with said assembly slot, to prevent disassembly of said rotor element and lock body.

9. A product locking device for use in connection with a product display hook, where the product display hook comprises upper and lower wire arms having outer end portions arranged in vertically spaced relation and wherein at least one of said outer end portions has an obstructive element associated therewith, and wherein said lower arm is adapted to support merchandise items for display, which comprises (a) a lock body having means at an upper portion thereof for attaching said lock body to said upper arm at a position inward of said obstructive element for pivotal movement about an axis of said upper arm, (b) said lock body having a locking slot therein having an open side and being sized and positioned to receive said lower arm, (c) a rotor element received in said lock body and rotatable therein through a predetermined angle of rotation, (d) a locking arm fixed to and extending outward from said rotor element, and rotatable therewith between "lock" and "open" positions of said rotor element, (e) said locking arm having an end portion arranged, when said rotor element is in said "lock" position, to close the open side of said locking slot for securing said lower arm within said slot, (f) one of said rotor element and said lock body having a locking recess therein, (g) the other of said rotor element or said lock body having a resiliently biased stop element thereon resiliently biased toward said locking recess, (h) said resiliently biased stop element being received in said locking recess when said recess and said stop element are rotationally aligned in the "lock" position of said rotor element, to normally prevent rotation of said rotor element out of said "lock" position, (i) said rotor element having an axially extending slot therein for reception of a key, and (j) a key insertable in said axially extending slot and having an outer surface portion engageable with said resiliently biased stop element to displace said element out of said recess to enable rotation of said rotor element to said "open" position in which said locking slot is open at the side thereof to permit pivotal movement of said lock body away from said lower arm to enable removal of a displayed product therefrom.

10. A product locking device according to claim 9, wherein (a) said rotor element is formed with at least one locking recess, and (b) said lock body is formed with at least one resiliently biased stop element.

11. A product locking device according to claim 9, wherein (a) a retaining bracket is attached to said product display hook, (b) said retaining bracket comprising front and back panels connected by an intermediate panel, (c) said front panel having an opening for receiving said lower arm, (d) said back panel having at least one opening therein aligned with an opening a display panel mounting said product display hook, and (e) a plunger actuated push pin inserted in said last mentioned openings for securing said retaining bracket to said display panel.

12. A product locking device according to claim 9, wherein (a) said lock body is formed with a slot for axially directed reception of said locking arm when said rotor element is assembled with said lock body.

13. A product locking device for use in connection with a product display hook, where the product display hook comprises upper and lower wire arms having outer end portions arranged in vertically spaced relation and wherein at least one of said outer end portions has an obstructive element associated therewith, and wherein said lower arm is adapted to support merchandise items for display, which comprises (a) a lock body having means at an upper portion thereof for attaching said lock body to said upper arm at a position inward of said obstructive element for pivotal movement about an axis of said upper arm, (b) said lock body having a locking slot therein having an open side and being sized and positioned to receive said lower arm, (c) a movable locking member received in said lock body and movable therein through a predetermined range of movement between "lock" and "open" positions, (d) said movable locking member including a locking element operative, in the "lock" position of said locking member, to close the open side of said locking slot for securing said lower arm within said slot, (e) one of said movable locking member and said lock body having a locking recess therein, (f) the other of said movable locking member or said lock body having a resiliently biased stop element thereon resiliently biased toward said locking recess, (g) said resiliently biased stop element being received in said locking recess when said recess and said stop element are aligned in the "lock" position of said movable locking member, to normally prevent movement of said locking member out of said "lock" position, (i) one of said movable locking member or said lock body having a key slot therein for reception of a key, and (j) a key insertable in said key slot and having an portion engageable with said resiliently biased stop element to displace said stop element out of said locking recess to enable movement of said movable locking member to said "open" position in which said locking slot is open at the side thereof to permit pivotal movement of said lock body away from said lower arm to enable removal of a displayed product therefrom.

14. A product locking device in accordance with claim 13, wherein (a) said movable locking member comprises a rotor element rotationally mounted by said lock body, and (b) said locking element comprises a locking arm rotatable with said rotor element and having a hook portion at its outer end for closing the open side of said locking slot.

15. A product locking device in accordance with claim 13, wherein (a) said means for attaching said lock body to said upper arm comprises an open-sided slot in an upper portion of said lock body, (b) a clip is pivotally attached to said lock body below said open-sided slot, (c) said clip having a tab at a free end thereof, and (d) said lock body is formed with a shoulder for snap-on engagement with said tab for securing said lock body to said upper arm.

16. A product locking device for use in connection with a product display hook, where the product display hook comprises upper and lower wire arms having outer end portions arranged in vertically spaced relation and wherein at least one of said outer end portions has an obstructive element associated therewith, and wherein said lower arm is adapted to support merchandise items for display, which comprises (a) a lock body having means at an upper portion thereof for attaching said lock body to said upper arm at a position inward of said obstructive element for pivotal movement about an axis of said upper arm, (b) said lock body having a locking slot therein having an open side and being sized and positioned to receive said lower arm, (c) a movable locking member received in said lock body and movable therein through a predetermined range of movement between "lock" and "open" positions, (d) said movable locking member including a locking element operative, in the "lock" position of said locking member, to close the open side of said locking slot for securing said lower arm within said slot, (e) one of said movable locking member and said lock body having a locking recess therein, (f) the other of said movable locking member or said lock body having a stop element thereon movable toward and away from said locking recess, (g) said movable stop element being received in said locking recess when said recess and said stop element are aligned in the "lock" position of said movable locking member, to normally prevent movement of said locking member out of said "lock" position, (i) one of said movable locking member or said lock body having a key recess therein for reception of a key, and (j) a key insertable in said key recess and having an portion engageable with said movable stop element to displace said stop element out of said locking recess to enable movement of said movable locking member to said "open" position in which said locking slot is open at the side thereof to permit pivotal movement of said lock body away from said lower arm to enable removal of a displayed product therefrom.

17. A product locking device for use in connection with a product display hook, where the product display hook comprises upper and lower wire arms having outer end portions arranged in vertically spaced relation and wherein at least one of said outer end portions has an obstructive element associated therewith, and wherein said lower arm is adapted to support merchandise items for display, which comprises (a) a lock body having means at an upper portion thereof for attaching said lock body to said upper arm at a position inward of said obstructive element for movement with respect to an axis of said upper arm while being retained on said upper arm, (b) said lock body having a locking slot therein having an open side and being sized and positioned to receive said lower arm, (c) a movable locking member received in said lock body and movable therein through a predetermined range of movement between "lock" and "open" positions, (d) said movable locking member including a locking element operative, in the "lock" position of said locking member, to close the open side of said locking slot for securing said lower arm within said slot, (e) one of said movable locking member and said lock body having a locking recess therein, (f) the other of said movable locking member or said lock body having a stop element thereon movable toward and away from said locking recess, (g) said movable stop element being received in said locking recess when said recess and said stop element are aligned in the "lock" position of said movable locking member, to normally prevent movement of said locking member out of said "lock" position, (i) one of said movable locking member or said lock body having a key recess therein for reception of a key, and (j) a key insertable in said key recess and having an portion engageable with said movable stop element to displace said stop element out of said locking recess to enable movement of said movable locking member to said "open" position in which said locking slot is open to permit movement of said lock body away from said lower arm to enable removal of a displayed product therefrom.

* * * * *